US010486447B1

(12) United States Patent
Knierim

(10) Patent No.: US 10,486,447 B1
(45) Date of Patent: Nov. 26, 2019

(54) PRINT HEAD SHUTTLING MOTION WITH IMPROVED PRECISION

(71) Applicant: XEROX CORPORATION, Norwalk, CT (US)

(72) Inventor: David L. Knierim, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/110,595

(22) Filed: Aug. 23, 2018

(51) Int. Cl.

| | |
|---|---|
| ***B41J 25/00*** | (2006.01) |
| ***B41J 2/15*** | (2006.01) |
| ***B41J 25/304*** | (2006.01) |
| ***B41J 2/24*** | (2006.01) |
| ***B41J 2/265*** | (2006.01) |
| *B41J 19/20* | (2006.01) |

(52) U.S. Cl.
CPC ..... *B41J 25/005* (2013.01); *B41J 2/15* (2013.01); *B41J 2/24* (2013.01); *B41J 2/265* (2013.01); *B41J 25/304* (2013.01); *B41J 19/205* (2013.01)

(58) Field of Classification Search
CPC ... B41J 25/005; B41J 2/265; B41J 2/24; B41J 2/15; B41J 25/304; B41J 19/205
See application file for complete search history.

(56) References Cited

U.S. PATENT DOCUMENTS 5,365,839 A * 11/1994 Yoshino ..... B41J 25/006 101/93.04
7,878,625 B2 2/2011 van Kalmthout et al.

FOREIGN PATENT DOCUMENTS

EP 1721755 A1 11/2006

* cited by examiner

*Primary Examiner* — Geoffrey S Mruk
(74) *Attorney, Agent, or Firm* — Miller Nash Graham & Dunn LLP

(57) ABSTRACT

A printing system has a print head shuttle containing a print head mounted on a print guide rail, a support shuttle containing support electronics for the print head mounted on a support guide rail adjacent and parallel to the print guide rail, and at least one electronic signal-carrying cable connected between the support electronics and the print head.

9 Claims, 3 Drawing Sheets

PRINT HEAD SHUTTLING MOTION WITH IMPROVED PRECISION

TECHNICAL FIELD

This disclosure relates to printing systems, more particularly to printing systems that shuttle the print head or heads across an image-receiving surface.

BACKGROUND

Many ink jet printing systems shuttle the print head across an image-receiving surface, such as paper or cloth. For precise imaging motion that results in precise ink placement for high quality images, it is desirable to minimize the mass of the print head and its associated close-proximity parts that shuttle with the head. The close-proximity parts typically consist of the electronics that generate and transmit the image-forming signals to the print heads to cause them to eject ink.

If the electronics reside on the shuttle with the print head, they add to the weight, which can lead to imprecision. If they reside elsewhere in the printing system, such as at a stationary location adjacent the print head path, the ink jet driving waveforms must travel a relatively long service loop to the print head. This can lead to signal degradation, and ultimately inferior jetting performance. To preserve the signals, the systems must use expensive and large service loop cables that raise the costs of the system dramatically.

SUMMARY

According to aspects illustrated herein, there is provided a printing system has a print head shuttle containing a print head mounted on a print guide rail, a support shuttle containing support electronics for the print head mounted on a support guide rail adjacent and parallel to the print guide rail, and at least one electronic signal-carrying cable connected between the support electronics and the print head.

DETAILED DESCRIPTION OF THE EMBODIMENTS

Figure 1:
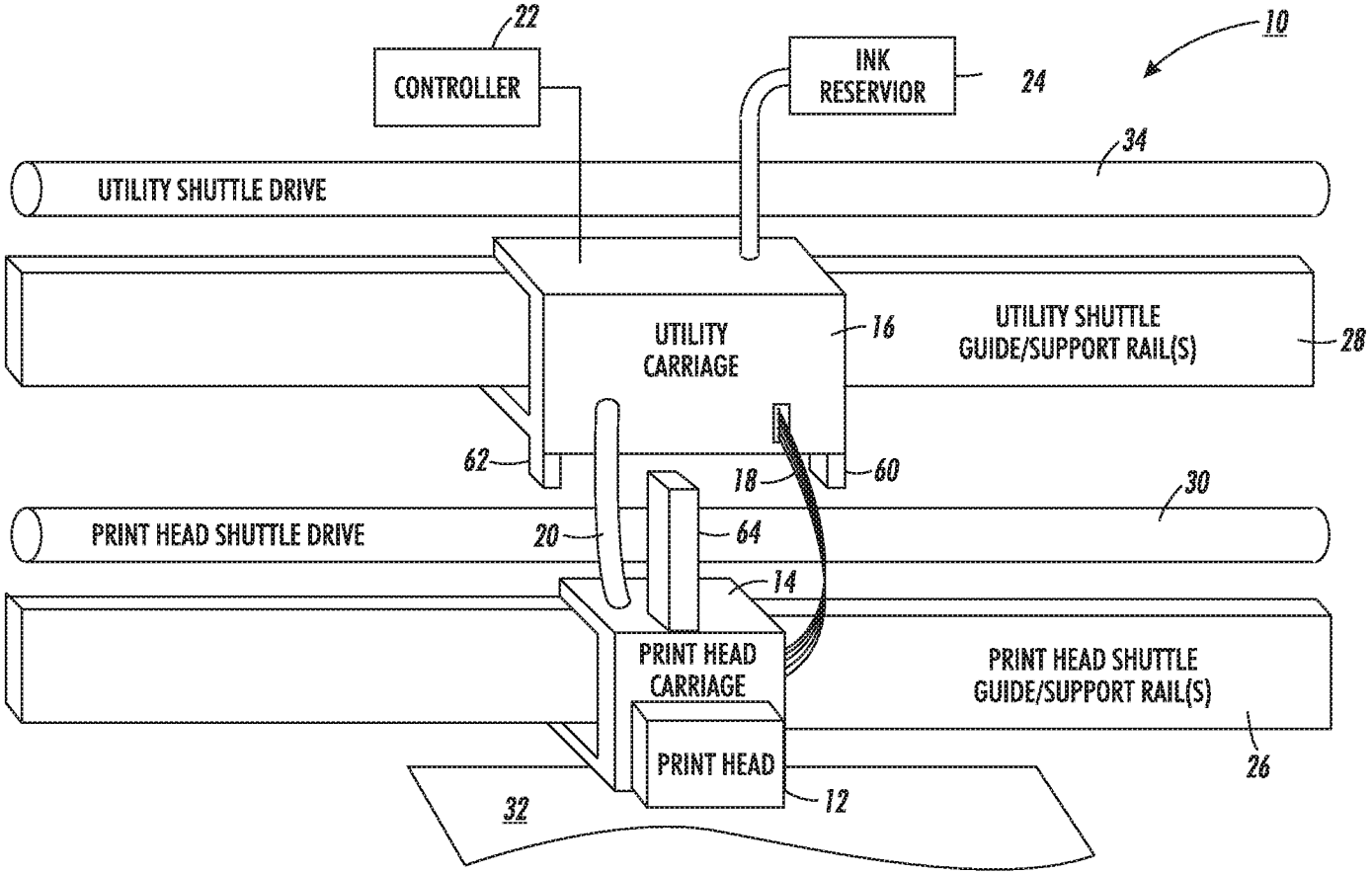
FIG. 1 shows an embodiment of a support shuttle mounted on a support rail adjacent to a print head mounted print head shuttle on a print rail.

FIG. 1 shows a system diagram of a print system 10 having a dual shuttling system, a first, more precise, print head shuttle 14 carrying the print head 12, mounted on a print guide rail 26, and a second, less precise, more likely heavier, utility shuttle 16 mounted on a separate utility guide rail 28. The utility shuttle 16 contains the electronics that generate the waveforms used to cause the print head 12 to dispense the ink onto the print surface 32. The shuttles move back and forth across the print surface 32 while the print head selectively deposits ink as determined by the image data sent from system controller 22 and formatted by electronics on the utility shuttle 16. The print head uses the image data to determine which jets connect to waveforms generated by electronics on the utility shuttle. The controller 22 may take the form of a computer or other computing device. It transmits the image data to the electronics carried on the utility shuttle 16 that generates the waveforms and formats image data for use by the print head and transmits them to the print head through the cable 18.

The utility shuttle 16 runs on a guide rail 28 that resides adjacent, and parallel, to the guide rail 26 upon which the print head shuttle resides. The utility shuttle runs adjacent to the print head shuttle and carries the heavier components, thereby lightening the load on the precision print head shuttle, and shortens the length of the cables such as 18 needed to transmit the waveforms and image data. The shorter cables prevent degradation of the waveform signals. This also allows the print head shuttle to run without the extra weight, which may lead to higher precision.

In addition to carrying the electronics and allowing for shorter cable lengths, the utility shuttle may also carry at least some of the components needed for ink delivery. This may alleviate even more of the weight being carried by the print head shuttle. In this case, a second conduit 20 transfers the ink from the reservoir 24 to the print head shuttle 14.

The two shuttles may also rely upon two different motive forces. The print head shuttle may rely upon a lead-screw, belt, band, or linear motor drive 30, with a precise positional encoder to provide feedback. The utility shuttle may use a lower-bandwidth, low-cost servo such as a belt drive, while the print head shuttle may use a higher-bandwidth and more precise drive such as a lead-screw. The utility shuttle only requires coarse encoder feedback, such as a hall sensor on the drive motor. The utility shuttle tracks the motion of the print head shuttle, but does so loosely, remaining within a few centimeters of the print head shuttle.

Figure 2:
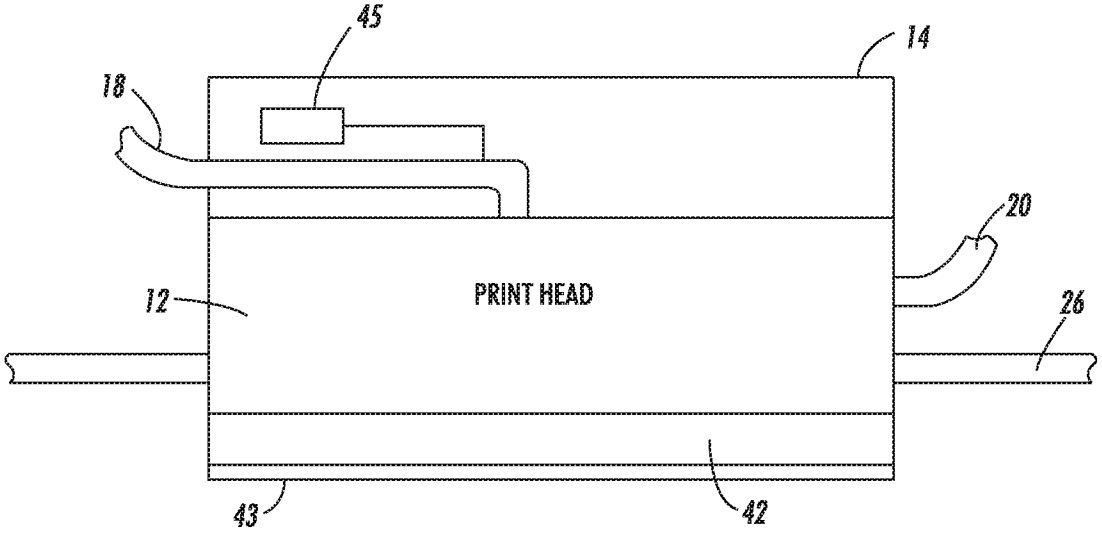
FIG. 2 shows a more detailed view of an embodiment of a print head mounted to a print head shuttle mounted on a print rail.
Figure 3:
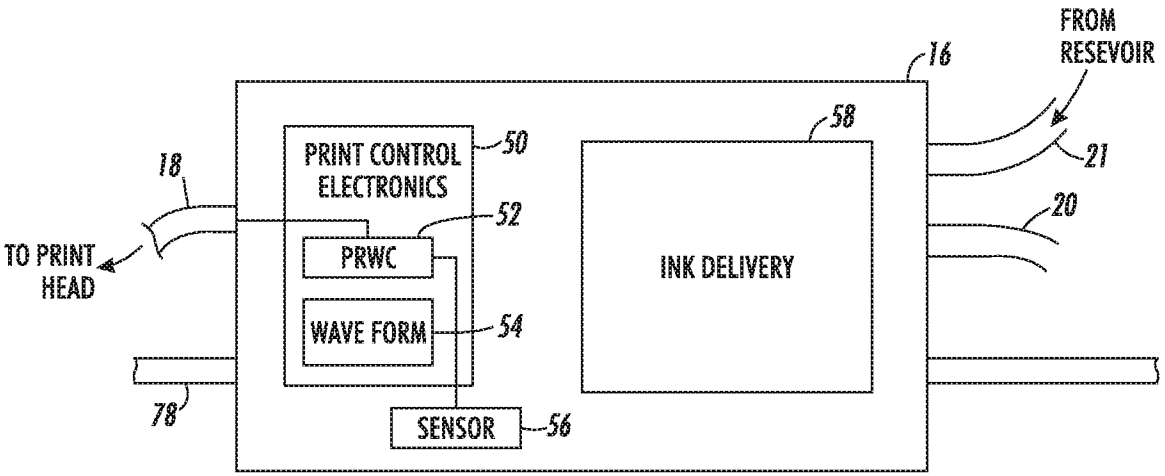
FIG. 3 shows a more detailed view of an embodiment of a support shuttle mounted on a support rail

FIG. 2 shows a more detailed view of an embodiment of a print head shuttle 14 on its guide rail 26. The print head shuttle carries the print head 12 that may consist of ink routing manifolds and other ink delivery structures and a jet stack 42. The jet stack may consist of a stack of plates that form pressure chambers for the array of nozzles 43 that dispense ink onto the print surface, but any structure that provides ink to the nozzles and selectively causes them to dispense ink will be referred to here as a jet stack. Ink enters the print head through the conduit 20, which may be connected to the utility shuttle, if the utility shuttle includes ink delivery structures, or directly from the prink reservoir 24 shown in FIG. 1.

While the print head shuttle may or may not include an ink conduit 20, it will include an electronics cable 18 that allows the print circuity to reside on the utility shuttle and send the image data and waveforms to the print head. This keeps the distance between the waveform generation circuitry and the drive electronics on the print head short, lessening the design constraints on the cables, as well as their length and costs. The print head will generally have drive electronics that receive the signals from the utility shuttle and transmit them to the jet stack. To manage the position of the print head shuttle, a precision position encoder 45 tracks the position of the print head shuttle. The waveform generation electronics on the utility shuttle use this position information to accurately match waveform timing with print head position. This position information is also used by the motor controller for the motor that positions the print head shuttle. The motor controller and motor typically reside elsewhere in the system 10.

As discussed above, the utility shuttle 16 may weigh more than the print head shuttle, but may only require a much less precise positioning system than the print head shuttle. FIG.

3 shows an embodiment of a utility shuttle 16 on its separate guide rail 28. The utility shuttle will contain the print control electronics 50 that receive the image data from a computing device connected to the printer system. A processor of some sort, such as a general purpose processor, an image processor, digital signal processor (DSP), an application specific integrated circuit (ASIC), field-programmable gate array (FPGA), or other type of device 52 receives the image data and formats it for the print head, along with generating the waveforms 54 sent to the print head through the electronic cable 18. This allows the print head shuttle to be lighter and keeps the cable lengths shorter to lower costs and avoid print degradation.

If the utility shuttle includes ink delivery structures 58, such as manifolds or other ink routing elements, the utility shuttle will include a conduit 20, also referred to as an umbilical, to provide ink to the print head. The utility shuttle will then have a conduit or umbilical 21 to receive ink from the ink reservoir 24, shown in FIG. 1. Moving at least some of the ink routing structures from the print head shuttle to the utility shuttle will lighten the print head shuttle even more than just moving the control electronics to the utility shuttle.

The motion of the utility shuttle does not require a high-precision motor or other motive force. The position of the utility shuttle may be tracked using a simple Hall sensor such as 56, rather than a more precise, complicated and expensive position encoder. This sensor will typically be part of the motor driving the utility shuttle, mounted to chassis 12, rather than local to the utility shuttle.

One issue may arise if the utility shuttle and the print head shuttle become separated at too great of a distance. This will place a strain on the electronics cable, and the print conduits if they are used. In the worst case, the separation could cause the cable to disconnect from one or both shuttles. One solution involves the use of mechanical stops to prevent one or the other shuttle from getting too far away from the other shuttle.

Returning to FIG. 1, the utility shuttle may have mechanical stops 60 and 62, and print head shuttle has a corresponding arm 64. If the utility shuttle 16 travels too far to one side or the other away from the print head shuttle, the mechanical stops 60 or 62 will bump against the arm 64. As long as the print head shuttle remains within a couple of centimeters in line with the print head shuttle, the system functions as intended. However, if the utility shuttle encounters one of the mechanical stops 60 or 62, the two shuttles have become too far apart. The system will shut down until an operator can resolve the issue. This prevents over-stretching the cables, possibly causes a disconnect or damage. Another option would be to have a cable or strap tying the two shuttles together, where the cable or strap is shorted than the cable or cables connecting the electronics, and the ink, between the two shuttles.

Generally, the protrusion 64 would not hit the stops 60 and 62 unless the motor control has already failed. The shuttle drive motors may have programming that causes them to shut down if they lose control. If one motor lost control before the motor controller realized it, hitting the stops would more than likely cause the other motor to lose control, shutting down the system until repairs can be made.

In this manner, a system using a print head shuttle can employ a utility shuttle to hold the electronics, and optionally ink delivery structures. This allows for a lighter print head shuttle for better control of its movement, while also allowing for shorted electronics cables to alleviate problems with signal degradation over longer distances.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printing system, comprising:

a print head shuttle containing a print head mounted on a print guide rail;

a support shuttle containing support electronics for the print head mounted on a support guide rail adjacent and parallel to the print guide rail, the support electronics including print circuity configured to receive image data from a computing device and output image data and waveforms to the print head; and at least one electronic signal-carrying cable connected between the support electronics and the print head to carry the image data and waveforms to the print head.

2. The printing system of claim 1, further comprising mechanical stops positioned to keep the print head shuttle and the support shuttle within a distance of each other shorter than a length of the at least one cable.

3. The printing system of claim 1, further comprising a print motor to provide movement to the print head shuttle.

4. The printing system of claim 1, further comprising a support motor to provide movement to the support shuttle.

5. The printing system of claim 4, wherein the support motor includes at least one hall sensor.

6. The printing system of claim 1, wherein the support guide rail is arranged behind the print guide rail.

7. The printing system of claim 1, wherein the support guide rail is arranged above the print guide rail.

8. The printing system of claim 1, wherein the print head shuttle includes a positional encoder.

9. The printing system of claim 1, wherein the support shuttle also contains ink delivery hardware.

* * * * *